US006874562B2

(12) United States Patent
Knott et al.

(10) Patent No.: US 6,874,562 B2
(45) Date of Patent: Apr. 5, 2005

(54) PROCESS FOR PRODUCING METAL/METAL FOAM COMPOSITE COMPONENTS

(75) Inventors: Wilfried Knott, Essen (DE); Benno Niedermann, Niederglatt (CH); Manfred Recksik, Essen (DE); Andreas Weier, Essen (DE)

(73) Assignees: Goldschmidt AG, Essen (DE); Buehler Druckguss AG, Uzwil (CH)

( * ) Notice: Subject to any disclaimer, the term of this patent is extended or adjusted under 35 U.S.C. 154(b) by 0 days.

(21) Appl. No.: 10/162,978

(22) Filed: Jun. 5, 2002

(65) Prior Publication Data

US 2002/0195222 A1 Dec. 26, 2002

(30) Foreign Application Priority Data

Jun. 7, 2001 (DE) ..... 101 27 716

(51) Int. Cl.[7] ..... B22D 27/00; B22D 17/08; B22D 19/04

(52) U.S. Cl. ..... 164/79; 164/98; 164/113

(58) Field of Search ..... 164/79, 113, 98

(56) References Cited

U.S. PATENT DOCUMENTS 3,773,098 A * 11/1973 Rock ..... 164/79
4,852,630 A * 8/1989 Hamajima et al. ..... 164/76.1
5,320,158 A * 6/1994 Helgesen ..... 164/76.1

FOREIGN PATENT DOCUMENTS

| | | |
|---|---|---|
| DE | 1164103 | 9/1964 |
| DE | 195 02 307 A1 | 10/1995 |
| DE | 195 01508 | 4/1996 |
| DE | 19744300 A1 | 4/1998 |
| DE | 29723749 U1 | 2/1999 |
| DE | 19832794 C1 | 10/1999 |
| EP | 0461052 B1 | 12/1991 |
| EP | 0666784 B1 | 8/1995 |
| EP | 0804982 A2 | 11/1997 |
| GB | 892934 | 4/1962 |
| JP | 03017236 | 1/1991 |
| JP | 07145435 | 6/1995 |
| JP | 09241780 | 9/1997 |
| WO | WO 92/21457 | 12/1992 |

* cited by examiner

*Primary Examiner*—Kuang Y. Lin
(74) *Attorney, Agent, or Firm*—Frommer Lawrence & Haug LLP

(57) ABSTRACT

The invention relates to a process for producing metal/metal foam composite components, wherein a flat or shaped metal part is introduced into the cavity of a die, the cavity being at least partially delimited by the metal part, and then a mixture comprising a metal melt and a blowing agent which is solid at room temperature is introduced into the cavity, where it is foamed.

16 Claims, No Drawings

PROCESS FOR PRODUCING METAL/METAL FOAM COMPOSITE COMPONENTS

RELATED APPLICATIONS

This application claims priority to German application 101 27 716.4, filed Jun. 7, 2001.

BACKGROUND OF THE INVENTION

1. Field of the Invention

The invention relates to a process for producing metal/metal foam composite components, in particular for producing shaped metal parts from light metal materials which have a reduced weight compared to conventionally produced shaped parts. The invention also relates to shaped parts produced using this process and to their use in light metal structures.

2. Description of the Related Art

Reducing the weight of shaped metal parts, for example for applications in automotive engineering, aircraft construction or other technologically highly demanding application areas is of considerable economic but also ecological importance. As well as the known use of light metals, foamed metallic materials are also receiving increasing attention. These materials are distinguished by a lightweight structure, a high rigidity and compressive strength, good damping properties, etc., and there are known processes for producing them.

It is known to produce components from foamed metallic materials. By way of example, cast cores of aluminum foam are surrounded with aluminum material by casting or are inserted as shaped parts into a component. The sheath and core or shaped part are produced separately and are then joined to one another. In addition to the high manufacturing outlay, this also leads to a low manufacturing quality. The basis of foamable semifinished aluminum products is atomized aluminum powder to which a blowing agent is added. By way of example, according to DE 197 44 300 A1, a body which has been pressed from a powder mixture is heated, in a heatable, closed vessel, to temperatures which are higher than the decomposition temperature of the blowing agent and/or the melting temperature of the metal.

In this process, the powder is compressed and the shaped part produced in this way is inserted into the area of a component which is to be filled by foaming, and is foamed by heating to up to 650° C. In the process, the sheath may be subject to unacceptable deformation, or the foaming operation may take place nonuniformly. Production of foams by sintering of metallic hollow spheres or infiltration of metal melts into cores or filler bodies, which are removed after solidification of the melt, is also possible.

According to a process described in JP 03017236 AA, metallic articles with cavities are produced by dissolving gases in a metal melt and initiating the foaming operation by suddenly reducing the pressure. The foam is stabilized by cooling of the melt.

According to the teaching given in JP 09241780 AA, metallic foam is obtained with the controlled release of blowing gases as a result of a metal initially being melted at temperatures which lie below the decomposition temperature of the blowing agent used. Subsequent dispersion of the blowing agent in the molten metal and heating of the matrix to above the temperature which is then required to release blowing gases leads to a metal foam being formed.

The casting of metal parts with lost foam is already known in accordance with EP 0 461 052 B1. WO 92/21457 A1 describes the production of aluminum foam in such a manner that gas is blown in below the surface of a molten metal, abrasives being used as stabilizers.

W. Thiele: Fullstoffhaltiger Aluminumschwamm—ein kompressibler Gusswerkstoff zur Absorption von Sto8energie, [Fillercontaining aluminum sponge—a compressible cast material for absorption of impact energy], in: Metall, 28, 1974, Vol. 1, pp. 39 to 42, describes the production of foamed aluminum. The desired cavities are predetermined in terms of size, shape and position in the form of a loose bed of readily compressible, inorganic light materials, such as for example expanded clay minerals, expanded clay, glass foam beads or hollow corundum beads, etc. The bed of light material is introduced into a die. The spaces which remain in the bed are filled with metal. The aluminum sponge obtained in this way has relatively poor mechanical qualities and contains the material of the bed.

DE 11 64 103 B describes a process for producing metal foam bodies. In this process, a solid material which, when heated, decomposes to form gases, is mixed with a molten metal in such a manner that the solid material is wetted by the metal. By way of example, pulverulent titanium hydride is added to a molten alloy of aluminum and magnesium at a temperature of 600° C. The closed foam formed in this way is then cast into a die, where it can cool and solidify. In this case too, it is clearly not a closed system, but rather an open system which is used.

GB 892934 relates to the production of complex structures with a foamed metal core and a closed, nonporous surface.

DE 198 32 794 C1 describes a process for producing a hollow profiled section which is filled with metal foam. This process comprises the steps of extruding the hollow profiled section from a sheathing material using an extruder which has an extrusion die with a die part and a mandrel, supplying the metal foam from a foam material to the hollow profiled section through a feed duct, which is formed in the mandrel JP Patent Abstracts of Japan 07145435 A describes the production of foamed metal wires. Molten aluminum is foamed in a furnace with the aid of a blowing agent and is fed to a continuously operating casting device. The molten aluminum in the foamed state is cooled between a pair of upper and lower conveyor belts in order to obtain an endless strand. This is cut in a predetermined way to form the foamed aluminum wires. Alternatively, the foamed aluminum wire or strand may be shaped by drawing the foamed, molten aluminum between a wire with a groove and a conveyor belt. Therefore, the molten aluminum wire is obtained by rolling or drawing.

EP 0 666 784 B1 describes a process for the shape casting of a metal foam which is stabilized by means of particles, in particular an aluminum alloy, by heating a composite of a metal matrix and finely divided solid stabilizer particles above the solidus temperature of the metal matrix and discharging gas bubbles into the molten metal composite below the surface thereof to thereby form a stabilized liquid foam on the surface of the molten metal composite. The characterizing feature is shape casting of the metal foam by the stabilized, liquid foam being pressed into a die, using a pressure which is just sufficient for the liquid foam to adopt the shape of the die, without the cells of the foam being significantly compressed, and then cooling and solidifying the foam, in order to obtain a shaped object. The foam is in this case pressed into the die by means of a moveable plate. A first moveable plate presses the liquid foam into the die, and a smooth surface is formed on the shaped foam object.

A second moveable plate is pressed into the foam inside the die, in order to form smooth inner surfaces on the foam object. However, the shaping may also take place by means of rollers.

A further process for making castings from metal foam is described in EP 0 804 982 A2. In this case, the foaming takes place in a heatable chamber outside a die, the volume of the powder metallurgy starting material introduced into the chamber for the metal foam, in its phase in which it has been foamed with the entire foaming capacity, substantially corresponding to the volume of a filled die. All the metal foam in the chamber is pressed into the die, in which foaming with the remaining foaming capacity is continued until the die has been completely filled. The die is a sand or ceramic die, the metal foam is inserted into the chamber as a semifinished product and is only pressed into the die, for example by means of a piston, after the initial foaming. When the foam is being pressed into the die, it is sheared. The die is not filled with a foam with a structure which is deliberately inhomogeneous.

DE 195 01 508 C1 discloses a process for producing a hollow profiled section of reduced weight and increased rigidity, for example a component for the chassis of a motor vehicle. It comprises die-cast aluminum, in the cavities of which there is a core of aluminum foam. The integrated foam core is produced by powder metallurgy and is then fixed to the inner wall of a casting die and surrounded with metal by pressure die-casting.

DE 297 23 749 U1 discloses a wheel for a motor vehicle which comprises at least one metallic foam core which is exposed toward the inner side of the wheel and has a cast wall toward the outer side of the wheel. The foamed core comprising aluminum foam is inserted into a permanent die in order to cast the wheel and is positioned in such a way that, during casting, the outer cast skin is formed between the permanent die and the foamed core.

DE 195 02 307 A1 describes a deformation element, in the housing of which a filling comprising an aluminum foam is provided as energy-absorbing means. The housing may consist of metal or plastic. The filling body is a simple insert part without any material-to-material bonding to the housing.

The dissolving or blowing of blowing gases into metal melts is not suitable for the production of near net shape components, since a system comprising melt with occluded gas bubbles is not stable for a sufficient time for it to be processed in shaping dies.

OBJECTS OF THE INVENTION

Therefore, it is an object of the invention to provide a simple process for producing composite components from metal and metal foam which is suitable for mass production.

SUMMARY OF THE INVENTION

The solution to the above object consists in a process for producing metal/metal foam composite components, wherein a flat or shaped metal part is introduced into the cavity of a die, the cavity being at least partially delimited by the metal part, and then a mixture comprising a metal melt and a blowing agent which is solid at room temperature is introduced into the cavity, where it is foamed.

Surprisingly, it has been discovered that, in particular, light metal foams, e.g. comprising aluminum or aluminum alloys, can be brought very efficiently by a casting operation, for example in a commercially available pressure die-casting machine, into cavities or onto the surface of prefabricated flat or shaped metal bodies, by using solid, gas-releasing blowing agents, e.g. a metal hydride, in particular a light metal hydride. In the process according to the present invention, liquid or pasty metal is forced into a die which forms the cavity which is to be filled by foaming.

This die may therefore limit the expansion of the metal foam which is formed on one or more sides, but at least part of the surface of the foam which is formed during this process in the interior of the cavity which is to be filled by foaming is formed by the previously inserted metal part.

The process according to the invention allows the production of a wide range of composite components. The metal parts may be a very wide range of shaped parts which are provided with a cavity and can be used in metal structures, for example hollow supports or rims. Therefore, it is also possible to use a wide range of casting processes, for example lowpressure or high-pressure die-casting processes.

In situations in which the die cavity which has been filled by foaming is only partially delimited by the inserted metal parts, it is possible, for example, to fill U- or L-shaped profile sections with metal foam. In the most simple case, the inserted metal part forms a metal sheet onto which metal foam can be foamed in accordance with the invention.

Insertion of a plurality of metal sheets which are arranged at a distance from one another into the die cavity therefore allows the simple production of sandwich components.

In the hot-chamber process, the metal is injected directly from the melting chamber at approx. $10^7$ Pa into the die, while in the cold-chamber process, which is preferred according to the invention, for example for materials comprising Al alloys and Mg alloys, the molten material is first pressed into a cold intermediate chamber and, from there, is then pressed into the die at more than $10^8$Pa. The casting performance of the hot-chamber process is higher, but so is the wear to the installation. The benefits of high-pressure die casting are the good strength of the material, the clean surfaces which are formed on the body which is formed on the inner side of the die cavity, the high dimensional accuracy, the possibility of forming castings of complex shape and the high working rate. These advantages can be improved further by subatmospheric pressure (vacuum in the die).

Commercially available, real-time controlled pressure diecasting machines are advantageous in this process. In a preferred embodiment of the present invention, the metals are selected from nonferrous metals and base metals, in particular are selected from magnesium, calcium, aluminum, silicon, titanium and zinc and the alloys thereof. On the other hand, ferrous metals and precious metals can also be foamed to a preshaped metal part to form the resulting composite part with the aid of the present invention. Where the present invention uses the term alloy, this term is to be understood as meaning that the alloy contains at least about 30% by weight of the metal mentioned. The process sequence which is preferred according to the invention comprises the step of introducing the required volume of molten metal into the shot sleeve or chamber and introducing it into a die cavity, into which the metal part which is to be filled by foaming has been inserted, with the blowing agent being added to the metal melt. In a preferred embodiment, metal melt and blowing agent are brought together in the die cavity, the die or the cavity which remains in the die being filled or underfilled with a defined volume of the melt/blowing agent mixture.

In a further preferred embodiment, the blowing agent is brought into contact with the metal melt not directly in the die cavity, but rather in a shot sleeve or chamber, and the mixture is then introduced into the die cavity containing the metal body which has been inserted.

The introduction of the blowing agent into the shot sleeve or chamber, on the one hand, and/or the cavity inside the die which remains after insertion of the piece of metal or of the inserted piece of metal, on the other hand, may take place before, during and/or after the introduction of the metal melt into the chamber in question.

However, for the present invention it is important for the foaming caused by the release of gases from the blowing agent, from a metal or metal alloy which is able to flow, substantially to take place only in the die cavity which is to be filled by foaming. This die cavity which is to be filled by foaming forms a closed die. However, it may have risers for venting, as is customary in pressure die-casting or the like. Then, the foamed metal composite body, comprising the shaped metal body which has been inserted into the die and the metal foam which has additionally been produced in the die cavity, is ejected.

In a further configuration, the blowing agent is added to the metal melt directly in the shot sleeve or chamber or in the die cavity, with the corresponding metal foam structure being produced in one operation in each case from the unfoamed metal body which was previously formed. This structure has as its surface either the surface of the inserted metal part or the surface which is newly formed in the die cavity during the formation of the foamed body. Even the foam surface which is newly formed at the wall of the die is smooth, and its formation is readily reproducible. Different wall thicknesses of this new foam surface are easy to establish on account of the spray filling which is possible in this process. The walls are closed on all sides, clean, nonporous and homogeneous. Further machining is not generally required.

Toward the inside, the regions of the metal composite body formed which have been produced in this process are increasingly porous and have a density gradient. With regard to its decomposition temperature, the blowing agent should be adapted to the melting temperature of the casting material (metal melt). The decomposition must only commence at above about 100° C. and should be no more than approximately 150° C. higher than the melting temperature.

In general, it is not necessary for the melting point of the metal melt or metal alloy which is forced in and forms the foam structure in the finished workpiece to be below the melting temperature of the metal which has previously been inserted into the die. On the contrary, in situations in which the melting temperature of the metal melt is higher than the melting temperature of the inserted metal part, a particularly good bond is formed between the preshaped metal part and the foam structure which is formed.

The quantity of blowing agent to be used depends on the required conditions. Within the context of the present invention, it is particularly preferable for the blowing agent to be used in a quantity of from about 0.1 to about 10% by weight, in particular about 0.2 to about 1% by weight, based on the mass of the quantity of metal used to form the metal foam.

Blowing agents which release gases and are solid at room temperature include, in particular, light-metal hydrides, such as magnesium hydride. In the context of the present invention, autocatalytically produced magnesium hydride, which is marketed, for example, under the name TEGO Magnan®, is particularly preferred. However, titanium hydride, carbonates, hydrates and/or volatile substances, which have already been used in the prior art to foam metals, can also be used in the same way.

The invention is described in more detail below in an exemplary embodiment. A vehicle component made from an aluminum material with an integrally foamed metal structure was to be produced on a commercially available pressure die-casting machine. For this purpose, a shot chamber of the pressure die-casting machine was filled with a corresponding quantity of metal melt. A metal structure which had previously been produced and in the interior had a cavity produced by a metal slide, was inserted into the die cavity of the pressure die-casting machine.

The insertion into the die chamber took place in such a manner that the runner (opening for introduction of the liquid metal) opened into the die cavity at the location of the metal cavity. Magnesium hydride in powder form was added to the liquid metal as blowing agent in the closed shot chamber of the pressure die-casting machine. At virtually the same time, the mixture of blowing agent and metal melt began to be pushed rapidly into the die cavity and therefore also into the cavity which remained in the inserted metal workpiece. The cavity was underfilled with a defined volume. The turbulence produced resulted in intimate mixing in the remaining die cavity, which assists the foaming operation. A foam structure was formed in the interior of the space in the inserted metal part, and this foam structure had a dense and homogeneous surface at the walls of the die. The "shot" took place prior to the formation of the foam, and the foaming process took place in situ in the die cavity. Rapid foaming took place in the die. In the interior of the structure previously formed, the component obtained had formed a foamed body which was firmly joined to the metal structure originally inserted, and this foamed body had a positive influence in particular on the fatigue performance compared to a comparison part which was not filled with foam.

The above description of the invention is intended to be illustrative and not limiting. Various changes or modifications in the embodiments described herein may occur to those skilled in the art. These changes can be made without departing from the scope or specification of the invention.

What is claimed is:

1. A process for producing a metal/metal foam composite component, wherein said metal/metal foam composite component comprises a flat or shaped metal part and a metal foam, in a high pressure injection die-casting machine comprising a die cavity, said method comprises placing the flat or shaped metal part into the die cavity so that the flat or shaped metal part at least partially delimits the die cavity; and forming a mixture comprising a metal melt and a blowing agent, which is solid at room temperature, in the die cavity, where the foaming takes place.

2. The process according to claim 1, wherein the die cavity is filled or underfilled with a defined volume and the foaming takes place in an unheated die cavity.

3. The process according to claim 1, wherein the mixture comprising the metal melt and the blowing agent is formed before introducing the mixture to the die cavity.

4. The process according to claim 3, wherein the die-casting machine further comprises a shot sleeve or a shot chamber and the mixture comprising the metal melt and the blowing agent is formed in the shot sleeve or shot chamber and is then introduced to the die cavity.

5. The process according to claim 1, wherein the die cavity is filled with the mixture comprising the metal melt and the blowing agent before foaming said mixture.

6. The process according to claim 1, wherein flat or shaped metal part delimits the die cavity on only one side.

7. The process according to claim 1, wherein the die casting machine further comprises more than one shot runners and the die cavity comprises more than one independent space, said spaces being filled by said shot runners.

8. The process according to claim 1, wherein the metal melt comprises a light metal.

9. The process according to claim 8, wherein the light metal is aluminum or aluminum alloy.

10. The process according to claim 8, wherein the light metal is Mg or Mg alloy.

11. The process according to claim 1, wherein the blowing agent is a metal hydride.

12. The process according to claim 11, wherein the metal hydride is a light metal hydride.

13. The process according to claim 12, wherein the light metal hydride is magnesium hydride or titanium hydride.

14. The process according to claim 1, wherein the blowing agent is autocatalytically produced magnesium hydride.

15. The process according to claim 1, wherein the process is a cold-chamber process.

16. The process according to claim 1, wherein the process is a hot-chamber process.

* * * * *